US005564387A

United States Patent [19]

Igarashi et al.

[11] Patent Number: 5,564,387

[45] Date of Patent: Oct. 15, 1996

[54] IDLING SPEED CONTROL SYSTEM AND METHOD THEREOF

[75] Inventors: Masanori Igarashi, Mitaka; Masaru Kurihara, Hino, both of Japan

[73] Assignee: Fuji Jukogyo Kabushiki Kaisha, Tokyo, Japan

[21] Appl. No.: 399,924

[22] Filed: Mar. 7, 1995

[30] Foreign Application Priority Data

Mar. 9, 1994 [JP] Japan ..... 6-038180

[51] Int. Cl.[6] ..... F02D 41/16

[52] U.S. Cl. ..... 123/339.23

[58] Field of Search ..... 123/339.19, 339.23

[56] References Cited

U.S. PATENT DOCUMENTS

| | | | |
|---|---|---|---|
| 4,491,108 | 1/1985 | Hasegawa et al. | 123/339.23 |
| 4,619,232 | 10/1986 | Morris | 123/339.23 |
| 4,700,675 | 10/1987 | Otobe et al. | 123/339.23 |
| 4,705,001 | 11/1987 | Danno et al. | 123/339.23 |
| 5,065,717 | 11/1991 | Hosokai et al. | 123/339.23 |
| 5,070,837 | 12/1991 | Nishimura et al. | 123/339.19 |
| 5,253,624 | 10/1993 | Anzai et al. | 123/339.23 |

*Primary Examiner*—Willis R. Wolfe

*Attorney, Agent, or Firm*—Beveridge, DeGrandi, Weilacher & Young, L.L.P.

[57] ABSTRACT

There is provided a system for controlling an idling speed of in engine, comprising an engine speed sensor provided to detect an engine speed and produce an engine speed signal indicative thereof, and a control unit provided to derive a physical amount corresponding to an engine torque being balanced with an engine friction around a predetermined target idling speed in response to the engine speed signal, and calculate a fuel injection amount to be injected by an injector and an opening degree of an idling speed control valve, both appropriate to the derived physical amount. There is further provided a method for controlling an idling speed of an engine, comprising detecting an engine speed, deriving a physical amount corresponding to an engine torque being balanced with an engine friction around a predetermined target idling speed in response to the engine speed, and calculating a fuel injection amount to be injected by an injector and an opening degree of an idling speed control valve, both appropriate to the derived physical amount.

17 Claims, 4 Drawing Sheets

IDLING SPEED CONTROL SYSTEM AND METHOD THEREOF

BACKGROUND OF THE INVENTION

The present invention relates to a system and a method for controlling an idling speed of an engine, and more specifically, for controlling the idling speed by simultaneously adjusting a fuel injection amount and an intake air amount passing through an idling speed control valve to improve responsibility of the control when an engine load varies.

Recently, various engines employ a fuel injection control for an injector and an idling speed control by means of an idling speed control valve provided in a passage bypassing a throttle valve.

In a conventional idling speed control as disclosed in Japanese laid-open patent application No. 60-212648, an error between an actual engine speed and a target idling speed is first calculated, and then an opening degree of the idling speed control valve is changed so as to reduce the error thus calculated, whereby the intake air amount is changed. Moreover, the intake air amount thus changed is detected by an air flow meter and the fuel injection control refers to the detected intake air amount to calculate a fuel injection amount to be injected by the injector, whereby the idling speed is maintained even when an engine load changes due to, for example, the operation of an air conditioner.

Such the conventional control, however, has an unsolved problem that the fuel injection delays since the fuel injection amount is derived after the change in the intake air amount is detected by the air flow meter. Therefore, when the engine load is abruptly varied, such the delay causes large fluctuations in the engine speed. In addition, there is a further problem that when the idling speed control valve sticks at its full open state, the fuel injection amount is excessively increased as well as the intake air amount passing through the idling speed control valve, causing the over-running of the engine even at the idling.

SUMMARY OF THE INVENTION

The present invention has been established in view of the above-described circumstances. An object of the present invention is to provide a system and a method for controlling an idling speed of engine in which a fuel injection amount and an opening degree of an idling speed control valve is simultaneously changed when an engine load is varied, thereby to improve the responsiveness of the idling speed control.

A further object of the present invention is to provide a system and a method for controlling an idling speed of an engine in which a physical amount regarded to be a linear relation with an engine torque is used as a parameter to calculate a fuel injection amount and an opening degree of an idling speed control valve simultaneously, whereby the engine speed is maintained to a target idling speed without any fluctuation.

For achieving the aforementioned objects, the present invention provides a system for controlling an idling speed of an engine, comprising an engine speed sensor provided to detect an engine speed and produce an engine speed signal indicative thereof, and a control unit provided to derive a physical amount corresponding to an engine torque being balanced with an engine friction around a predetermined target idling speed in response to the engine speed signal and calculate a fuel injection amount to be injected by an injector and an opening degree of an idling speed control valve, both appropriate to the derived physical amount.

More specifically, the present invention provides system for controlling an idling speed of an engine, comprising an engine speed detecting means for detecting an engine speed and producing an engine speed signal indicative thereof, an intake air pressure detecting means for detecting a pressure of intake air and producing an intake air pressure signal indicative therof, a physical amount providing means responsive to the engine speed signal for providing a physical amount corresponding to an engine torque being balanced with an engine friction around a predetermined target idling speed, a fuel injection amount calculating means for calculating a fuel injection amount in accordance with the physical amount, the fuel injection amount being injected by an injector, a passing air amount calculating means responsive to the engine speed signal and the intake air pressure signal for estimating an amount of air passing through an idling speed control valve necessary to supply an amount of air corresponding to the physical amount to a cylinder, and an opening degree determining means for determining an opening degree of the idling speed control valve in accordance with the estimated amount of air passing through the idling speed control valve, the idling speed control valve being opened by the determined opening degree.

The present invention further provides a method for controlling an idling speed of an engine, comprising detecting an engine speed, deriving a physical amount corresponding to an engine torque being balanced with an engine friction around a predetermined target idling speed in response to the engine speed, and calculating a fuel injection amount to be injected by an injector and an opening degree of an idling speed control valve, both appropriate to the derived physical amount.

According to the foregoing aspects of the present invention, the delay of the fuel injection is avoided during the idling state of the engine since the fuel injection amount is not responsive to the intake air amount detected by the sensor but to the change of the engine speed. Therefore, the fluctuations of the engine speed at the engine load change is eliminated.

Moreover, in the accidental case where the idling speed control valve sticks at its full open, although the amount of supplied air through the idling speed control valve is maximum, the over running of the engine is avoided since the fuel injection amount responsive to the change of the engine speed and therefore the fuel injection amount is excessively decreased.

BRIEF DESCRIPTION OF DRAWINGS

FIG. 2(*b*) is an explanatory view showing a relationship between an intake air amount per intake stroke and an intake air pressure;

FIG. 2(*c*) is an explanatory view showing a duty ratio map used in the idling control according to the present invention;

FIG. 5(*b*) is an explanatory view showing a change in engine speed after racing.

DETAILED DESCRIPTION OF THE PREFERRED EMBODIMENT

The preferred embodiments of the present invention will be described hereinafter with reference to the drawings.

Figure 1:
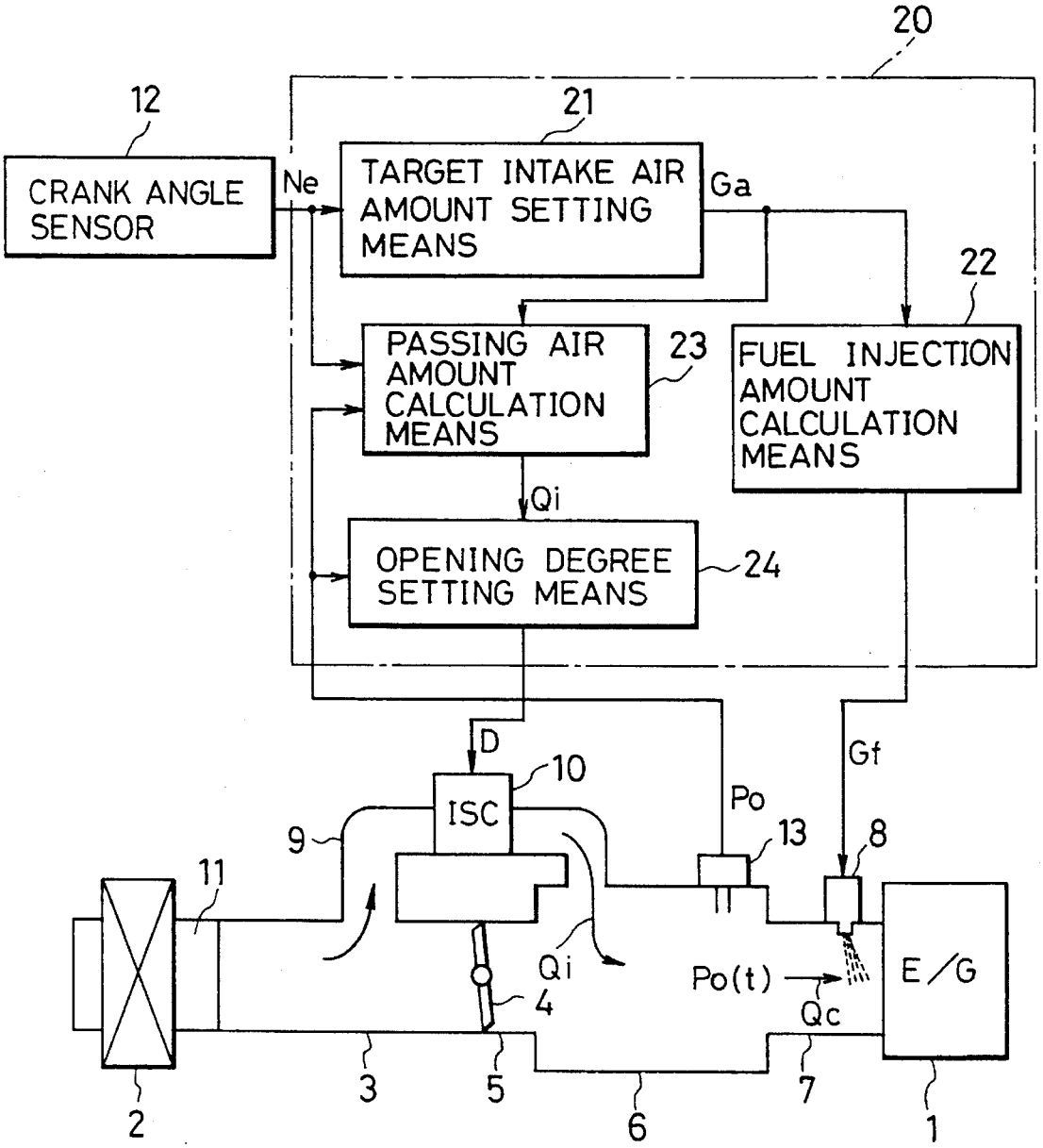
FIG. 1 is structural view showing an idling control system according to the present invention.

In FIG. 1, the structure of an engine intake system will be described. Reference numeral 1 denotes a 4-cylinder engine. As the intake system of the engine 1, an air cleaner 2 is communicated through an intake pipe 3 with a throttle body 5 having a throttle valve 4 therein. Throttle body 5 is communicated with an intake port of each cylinder of the engine 1 through a chamber 6 and an intake manifold 7. An injector 8 for the fuel injection is mounted on the intake manifold 7. An idling speed control valve 10 is installed in a passage 9 bypassing the throttle valve 4 for controlling an intake air amount passing through the idling speed control valve 10 and flowing into the cylinder at the time of idling when the throttle valve 4 is fully closed.

An air flow meter 11 for measuring an intake air amount Q is provided downstream the air cleaner 2. The engine 1 is provided with a crank angle sensor 12 for detecting an engine speed Ne. A pressure sensor 13 for detecting an intake air pressure PO (an absolute pressure) is provided on the chamber 6 downstream the throttle valve 4. Signals from those sensors are input to a control unit 20. Particularly at the time of idling, signals from the crank angle sensor 12 and the intake air pressure sensor 13 are processed by the control unit 20 to output a duty signal to the idling speed control valve 10 and an injection signal to the injector 8.

Prior to explaining the details about the control unit 20, a basic construction of the idling speed control according to the present invention will be described.

Figure 2A:
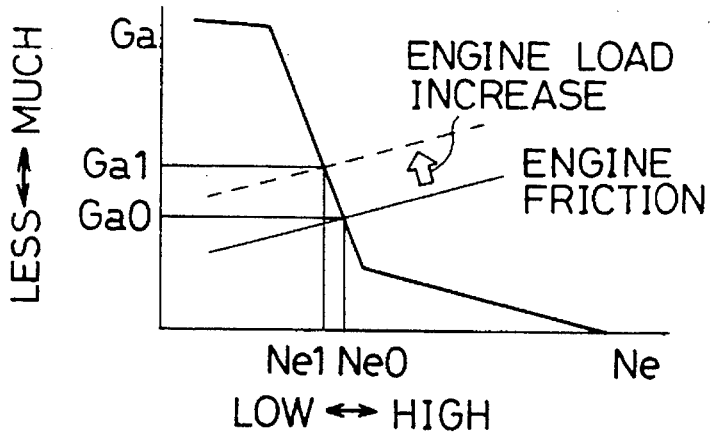
FIG. 2(*a*) is an explanatory view showing a Ga—Ne map used in the idling control according to the present invention.
Figure 2B:
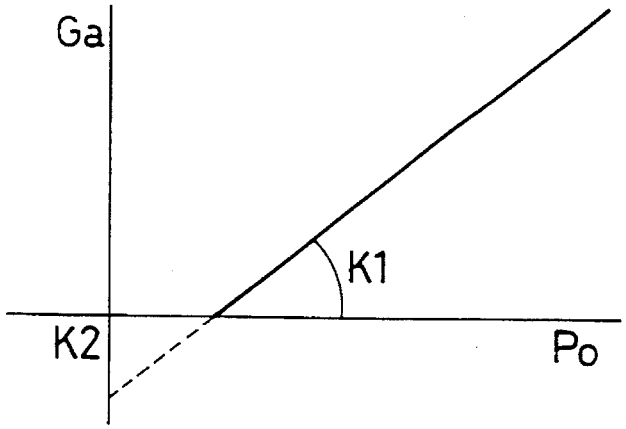
Figure 2C:
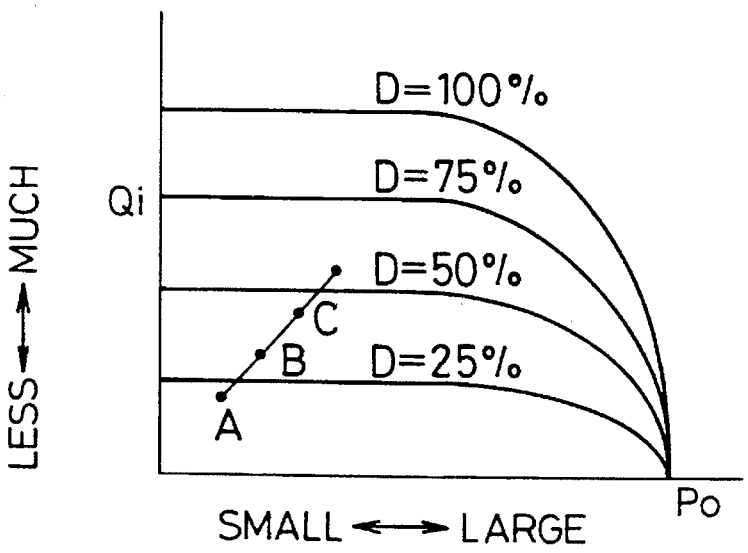

First, the change of the engine load at idling can be determined by the change in the engine speed Ne. In this case, a target intake air amount Ga (unit: g/cycle) per engine cycle (hereinafter sometimes referred as the intake air amount Ga) necessary for maintaining the engine speed Ne to or around a target idling speed can be experimentally determined in accordance with the engine speed and defined in a form of a Ga—Ne map as shown in FIG. 2(*a*). Accordingly, when the engine speed changes due to the change of the engine load, the target intake air amount Ga is derived from the Ga—Ne map in accordance with the changing engine speed, and a fuel injection amount Gf per engine cycle can be immediately calculated based on the derived target intake air amount Ga and a target air/fuel ratio S at idling by the following equation.

$$Gf=Ga/S \tag{1}$$

To arrange the Ga—Ne map, first an intake air amount GaO per engine cycle required to generate an engine torque in equilibrium with a friction of the engine at the target idling speed NeO is experimentally obtained. Then, with this intake air amount GaO as the central figure, the Ga—Ne map is so configured that as the smaller engine speed, the target intake air amount Ga becomes larger, and as the larger engine speed, the target intake air amount Ga becomes smaller. Therefore, assuming the case where the engine friction increases due to the increase of the engine load as indicated in FIG. 2(*a*), the intake air amount Ga is increased with the decrease of the engine speed along a characteristic line in the Ga—Ne map and an increased engine torque caused by an intake air amount Ga1 provided at the engine speed Ne1 becomes equilibrium with an increased engine friction, whereby the engine speed is converged to and maintained at Ne1, little a bit smaller than the target idling speed but still equivalent thereto.

Moreover, an opening degree of the idling speed control valve 10 is controlled based on the target intake air amount Ga thus obtained as well as the fuel injection amount. Since the intake air amount Ga is in a linear relation with the intake air pressure PO downstream the throttle valve 4 as shown in FIG. 2(*b*), the intake air amount Ga can be replaced by the intake air pressure PO based on the equation as follows.

$$Ga=K1*PO-K2 \tag{2}$$

where K1 and K2 are constants. Thererfore, the target intake air amount Ga corresponds to a target intake air pressure PO(t+Δt) a predetermined time Δt hence. Accordingly, the target intake air pressure PO(t+Δt) is estimated as being equal to that obtained by adding an estimated amount Qi (g/sec) of air passing through the idling speed control valve 10 the predetermined time Δt hence to a present intake air pressure PO(t) and subtracting an estimated amount Qc (g/sec) of air to be induced into cylinder the predetermined time Δt hence. This relationship can be described by the following equations.

$$PO(t+\Delta t)=PO(t)+(Qi*\Delta t-Qc*\Delta t)/K3 \tag{3}$$

$$Qc=4*Ga*(Ne/2)*(1/60) \tag{4}$$

where K3 is a constant based on the equation of state and Qc is a value in case of the 4-cylinder engine. Based on this relationship, the estimated amount Qi of air passing through the idling speed control valve 10 can be calculated, on which an opening degree of the idling speed control valve 10 is determined.

In this manner, when the engine load is varied, the fuel injection amount Gf and the opening degree of the idling speed control valve 10 can be simultaneously controlled.

To perform the foregoing logic of the control, the control unit 20 is functionally constructed as follows.

The control unit 20 includes a target intake air amount determination block 21 which inputs the engine speed Ne from the crank angle sensor 12 and provides a target intake air amount Ga (unit: g/cycle) per engine cycle from the Ga—Ne map in accordance with the input engine speed Ne when an idling state of the engine is determined. The intake air amount Ga is input to a fuel injection amount calculation block 22 where a fuel injection amount Gf per engine cycle is calculated based on the foregoing equation (1). Then, The fuel injection amount calculation block 22 outputs a fuel injection signal indicative of the calculated fuel injection amount Gf to the injector 8.

Moreover, the engine speed Ne, the intake air amount Ga, and the intake air pressure detected by the pressure sensor 13 are input into a passing air amount calculation block 23 to calculate the estimated amount Qi of air passing through the idling speed control valve 10 the predetermined time Δt hence, based on the foregoing equations (2) to (4).

The estimated amount Qi of air passing through the idling speed control valve 10 and the present intake air pressure PO(t) are input to an opening degree setting block 24 to derive from a duty ratio map shown in FIG. 2(*c*) a duty ratio D of pulse signals to be supplied to the idling speed control valve 10. The duty ratio D corresponds to the opening degree of the idling speed control valve 10. In the duty ratio map, the duty ratio D is set as an increasing function with respect to the calculated amount Qi of air passing through the valve 10. Furthermore, the duty ratio D is also set as an increasing function with respect to the intake air pressure PO(t) since essentially the amount of air passing through the valve 10 varies depending on the magnitude of the intake air pressure, more specifically, a pressure difference between the intake air pressure and an atmospheric pressure.

In the operation conditions other than the idling, generally the idling speed control valve 10 is fully closed by D=0%, and the fuel injection amount is calculated in the usual manner based on the engine speed and the intake air amount sensed by the air flow meter 11.

Figure 3:
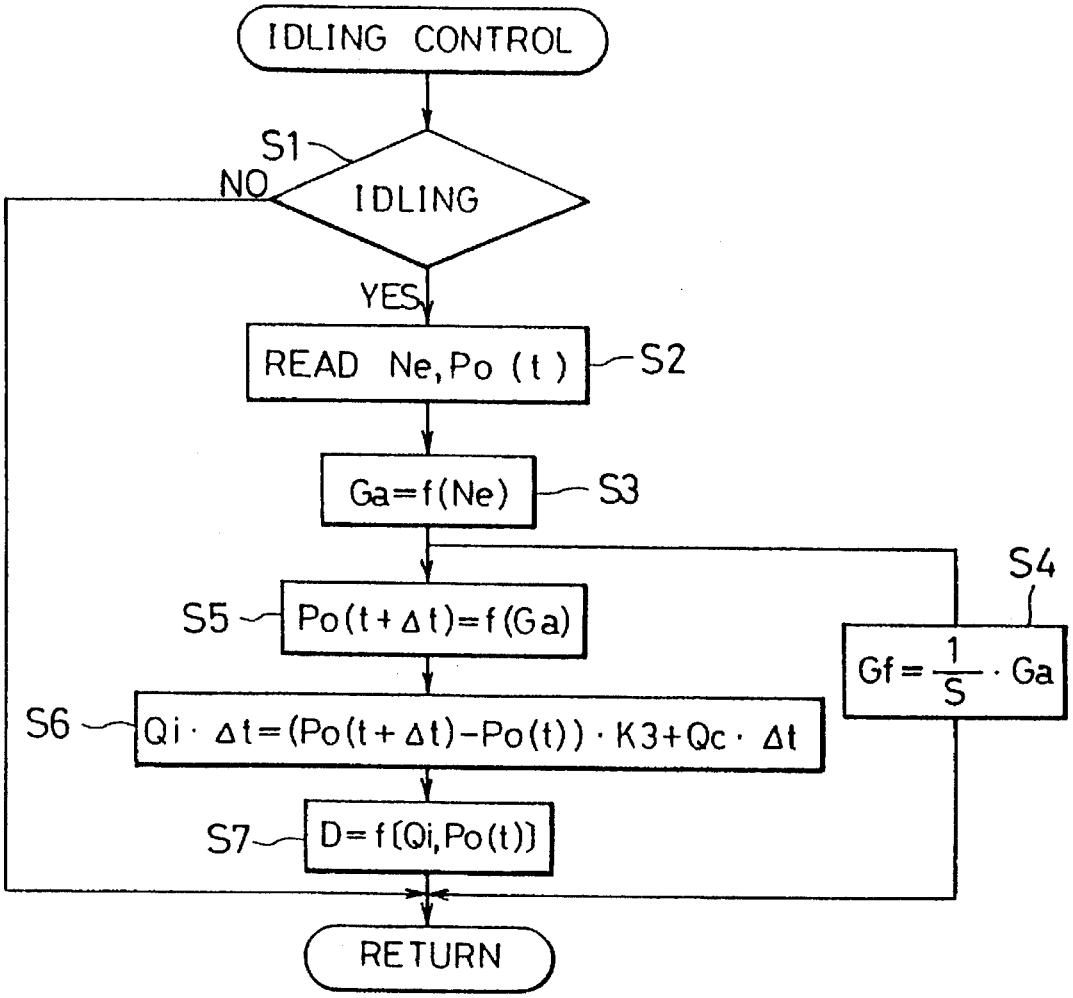
FIG. 3 is a flowchart showing the idling control according to the present invention.

Next, the operation of the above-described idling control system will be described with reference to the program flowchart shown in FIG. 3 and the time chart shown in FIG. 4.

First, in Step S1, it is determined whether the engine 1 is in the idling state. When the engine 1 is in the idling state, the program proceeds to Step S2, where the actual engine speed Ne and the present intake air pressure PO(t) are read from the crank angle sensor 12 and the intake air pressure sensor 13, respectively. Thereafter, in Step S3 the target intake air amount Ga per engine cycle is derived from the Ga—Ne map shown in FIG. 2(*a*) in accordance with the engine speed Ne read in Step S2. After this, in Step S4, the fuel injection amount Gf is calculated from the target intake air amount Ga thus derived and the target air/fuel ratio S with the equation (1).

Moreover, in Step S5, the target intake air pressure PO(t+Δt) the predetermined time Δt hence is calculated from the target intake air amount Ga based on the equation (2). Then, in Step S6, the estimated amount Qi of air passing through the idling control valve 10 the predetermined time Δt hence is calculated from the present intake air pressure PO(t) read in Step S2, the target intake air pressure PO(t+Δt) calculated in Step S5, and the amount Qc of air to be induced into the cylinder using the equations (3) and (4). In succeeding Step S7, the duty ratio D of the pulse signals to be supplied to the idling speed control valve 10 is derived from the duty ratio map shown in FIG. 2(*c*) in accordance with the estimated amount Qi of air passing through the idling speed control valve 10 calculated in Step S6 and the present intake air pressure PO(t) read in Step S2.

In accordance with the foregoing idling speed control, when the engine load increases, the fuel injection amount Gf and the opening degree of the idling speed control valve 10 are immediately increased simultaneously such that the engine torque increases to balance with the increased engine friction around the target idling speed.

Figure 4:
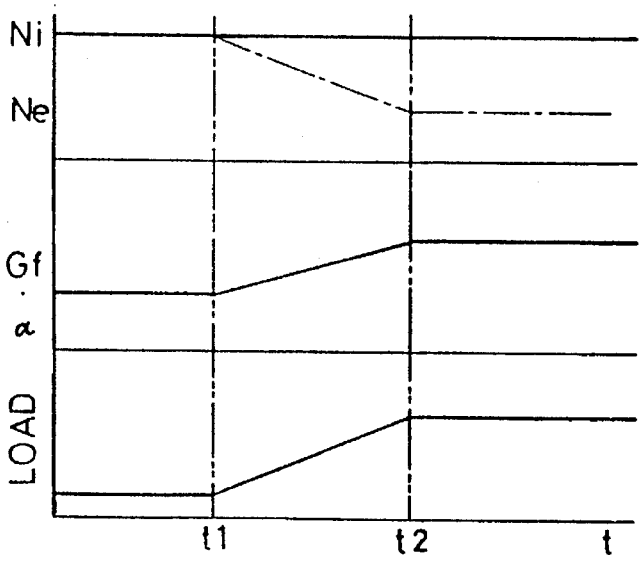
FIG. 4 is a time chart of the idling control according to the present invention.

In the time chart shown in FIG. 4, the engine speed Ne is maintained to the target idling speed Ni by a certain fuel injection amount Gf and a certain duty ratio D indicated as a point A in FIG. 2(*c*) until a time t1. In the case where the engine load increases between times t1 and t2 due to, for example, the operation of the air conditioner, the engine speed Ne is going to drop as indicated by the dashed line. According to the present invention, however, the target intake air amount Ga per engine cycle is increased by the Ga—Ne map with the decrease of the engine speed Ne, and therefore, the fuel injection amount Gf is increased. Moreover, the estimated amount Qi of air passing the idling speed control valve 10 is also increased because of the increase of the target intake air amount Ga, and therefore the duty ratio D gradually increases as indicated B and C in FIG. 2(*c*). Thus, the engine speed is prevented from excessively dropping and maintained to the target idling speed Ni.

Figure 5A:
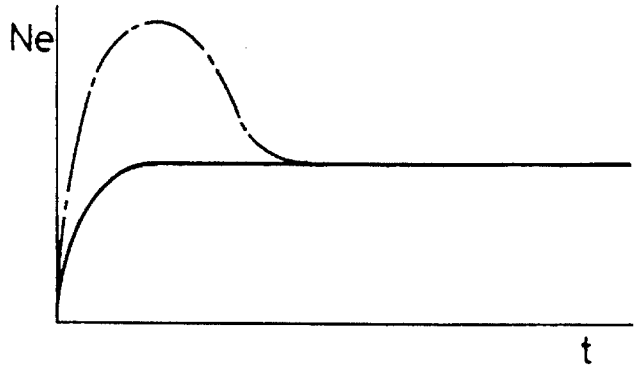
FIG. 5(*a*) is an explanatory view showing a change in engine speed at the time of engine start.
Figure 5B:
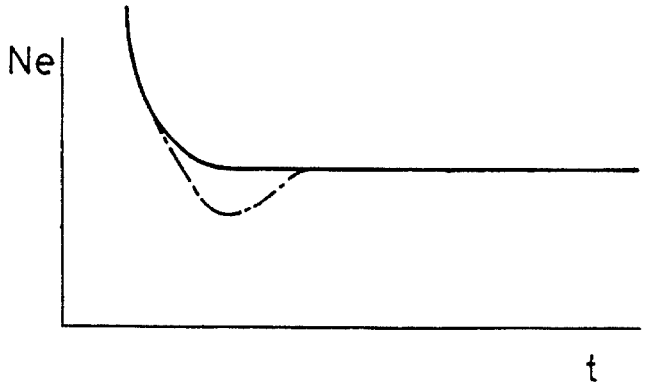

The idling speed control according to the present invention functions at the engine start and the racing as well. As shown in FIG. 5(*a*), at the engine start, the engine speed Ne smoothly increases to the target idling speed without any overshoot as indicated by a dashed line. Moreover, after the racing, the engine speed Ne gradually decreases as shown in FIG. 5(*b*) and the undershoot as indicated by a dashed line of the engine speed is avoided.

As described above, according to the present invention, the delay of the fuel injection is avoided during the idling state of the engine since the fuel injection amount is not responsive to the intake air amount detected by the sensor but to the change of the engine speed. Therefore, the fluctuations of the engine speed at the engine load change is eliminated.

Moreover, in the accidental case where the idling speed control valve sticks at its full open, although the amount of supplied air through the idling speed control valve is maxmum, the over running of the engine is avoided since the fuel injection amount is responsible to the change of the engine speed and therefore the fuel injection amount is excessively decreased.

Although in, the present embodiment, the target intake air amount per engine cycle is used as a parameter to control both the fuel injection amount and the opening degree of the idling speed control valve, any other physical, amount regarded to be a linear relation with the engine torque can be used in the same manner. As such a physical, amount, an absolute intake air pressure or fuel injection amount can be adopted.

While the presently preferred embodiment of the present invention has been shown and described, it is to be understood that this disclosure is for the purpose of illustration and that changes and modifications may be made without departing from the scope of the invention as set forth in the appended claims.

What is claimed is:

1. A system for controlling an idling speed of an engine having a cylinder, an injector for injecting fuel to said engine, an intake passage connected to said engine for inducing air into said cylinder, a throttle valve interposed between said intake passage, a bypass passage provided in parallel with said intake passage for bypassing said throttle valve, an idling speed control valve interposed in said bypass passage for adjusting an amount of air flowing into said cylinder during an idling state of said engine, an engine speed sensor mounted on said engine for detecting an engine speed and for generating an engine speed signal, and a pressure sensor provided downstream of said throttle valve for sensing air pressure and for producing a pressure signal, the system comprising:

target value setting means responsive to said engine speed signal for deciding a target value of a parameter proportionally variable with an engine torque balanced with respect to an engine load when said engine is operating approximately in a predetermined target idling condition and for producing a target value signal; and simultaneous calculating means, responsive to said target value signal, for simultaneously calculating both a fuel injection amount to be injected by said injector and an opening degree of said idling speed control valve so as to avoid a fuel injection delay and fluctuation of said engine speed even when said engine load suddenly changes.

2. The system according to claim 1, wherein said parameter is an intake air amount per engine cycle being linearly related to engine torque.

3. The system according to claim 1, wherein said parameter is an absolute intake air pressure being linearly related to engine torque.

4. The system according to claim 1, wherein said parameter is a fuel injection amount per engine cycle being linearly-related to engine torque.

5. The system according to claim 1, wherein said simultaneous calculating means further comprises:

idling air amount calculating means, responsive to said engine speed signal, for calculating an air amount for idling of said engine and for producing air amount signal;

fuel injection amount calculating means, responsive to said target value signal, for calculating said fuel injection amount corresponding to said parameter and for controlling said fuel injector; and opening degree determining means, responsive to said air amount signal and said pressure signal, for determining an opening degree of said idling speed control valve so as to supply an optimum amount of air corresponding to said parameter.

6. A system for controlling an idling speed of an engine having a cylinder, an injector for injecting fuel to be supplied to said cylinder, an intake passage connected to said engine for inducing air into said cylinder, a throttle valve interposed between said intake passage, a bypass passage provided in parallel with said intake passage for bypassing said throttle valve, an idling speed control valve interposed in said bypass passage for adjusting an amount of air flowing into said cylinder during an idling state of said engine, an engine speed sensor mounted on said engine for detecting an engine speed and for generating an engine speed signal, and a pressure sensor provided downstream of said throttle valve for sensing air pressure and for producing a pressure signal, comprising:

target value setting means responsive to said engine speed signal for deciding a target value of a parameter which is proportionally variable with an engine torque balanced with respect to an engine load when said engine is operating approximately at a predetermined target idling condition and for producing a target value signal;

fuel injection amount calculating means, responsive to said target value signal, for calculating a fuel injection amount in accordance with said parameter and for controlling said fuel injector;

passing air amount calculating means responsive to said engine speed signal, said target value signal, and said pressure signal for estimating an estimated amount of air passing through said idling speed control valve necessary to supply an amount of air corresponding to said parameter to said cylinder and for generating an air amount signal; and opening degree determining means, responsive to said air amount signal, for determining an opening degree of said idling speed control valve in accordance with said estimated amount of air passing through said idling speed control valve so as to avoid a fuel injection delay and fluctuations of said engine speed even when said engine load suddenly changes.

7. The system according to claim 6, wherein said opening degree determining means is further responsive to said pressure signal to derive an opening degree of said idling speed control valve in accordance with both said estimated amount of air and said intake air pressure.

8. A method of controlling an idling speed of an engine having a cylinder, an injector for injecting fuel to said cylinder, an intake passage, a throttle valve installed in said intake passage, a bypass passage for bypassing said throttle valve, and an idling speed control valve installed in said bypass passage for adjusting an amount of air flowing into said cylinder during an idling state of said engine, the method comprising:

detecting an engine speed;

deriving a parameter corresponding to an engine torque balanced with respect to engine load around a predetermined target idling speed; and calculating simultaneously both a fuel injection amount and an opening degree of said idling speed control valve, both appropriate to said derived parameter.

9. The method according to claim 8, wherein said parameter is an intake air amount per engine cycle being in a linear relation with said engine torque.

10. The method according to claim 8, wherein said parameter is an absolute intake air pressure being in a linear relation with said engine torque.

11. The method according to claim 8, wherein said parameter is a fuel injection amount being in a linear relation with said engine torque.

12. The method according to claim 8, wherein said calculating step comprises:

calculating said fuel injection amount corresponding to said parameter estimating an amount of air passing through said idling speed control valve necessary to supply an amount of air corresponding to said parameter to said cylinder; and determining said opening degree of said idling speed control valve in accordance with said estimated amount of air passing through said idling speed control valve.

13. A system for controlling an idling speed of an engine having a cylinder, an injector for injecting fuel to said engine, an intake passage connected to said engine for inducing an air into said cylinder, and a throttle valve interposed between said intake passage, comprising:

target value setting means responsive to an engine speed signal for deciding a target value of a parameter proportionally variable with an engine torque balanced with respect to an engine load when said engine is operating approximately in a predetermined target idling condition and for producing a target value signal indicative thereof; and means, responsive to said target value signal, for simultaneously calculating both a fuel injection amount to be injected by said fuel injector and an air intake amount to be mixed with said fuel injection amount so as to avoid a fuel injection delay and fluctuations of said engine speed even when said engine load suddenly changes.

14. A system for controlling an idling speed of an engine, comprising:

an injector for injecting fuel to said engine;

an intake passage connected to said engine for inducing air into said engine;

a throttle valve interposed in said intake passage;

a bypass passage provided in parallel with said intake passage for bypassing said throttle valve, an idle speed control valve interposed in said bypass passage for adjusting an air amount flowing into said engine during an idling state of said engine;

an engine speed sensor mounted on said engine for detecting an engine speed and for generating an engine speed signal;

a pressure sensor provided downstream of said throttle valve for sensing a pressure of said induced air and for producing a pressure signal indicative thereof;

target value setting means responsive to an engine speed signal for deciding a target value of a parameter proportionally variable with an engine torque balanced with respect to an engine load when said engine is operating approximately in a predetermined target idling condition and for producing a target value signal; and means, responsive to said target value signal, for simultaneously calculating both a fuel injection amount to be injected by said fuel injector and an opening degree of said idling speed control valve so as to avoid a fuel injection delay and fluctuations of said engine speed even when said engine load suddenly changes.

15. A method of controlling an idling speed of an engine, the method comprising:

turning on an ignition switch and starting said engine;

detecting an engine speed;

deriving a parameter corresponding to an engine torque balanced with respect to engine load around a predetermined target idling speed; and calculating simultaneously both a fuel injection amount and an air intake amount, both appropriate to said derived parameter.

16. A method for controlling the idling of an engine, comprising:

detecting an engine speed;

producing an engine speed signal indicative of said engine speed;

converting said engine speed signal to a parameter corresponding to an engine torque being balanced with an engine friction around a predetermined target idling speed; and calculating simultaneously a desired fuel injection amount and a desired air intake amount based on said parameter.

17. A method for controlling the idling of an engine as recited in claim 16, further comprising, after the calculating step, the step of:

injecting both said desired fuel injection amount and introducing said desired air intake amount into said engine.

* * * * *